United States Patent [19]

Raffler

[11] Patent Number: 5,012,533

[45] Date of Patent: May 7, 1991

[54] HELMET

[75] Inventor: Dieter Raffler, Ulm, Fed. Rep. of Germany

[73] Assignee: K. W. Hochschorner GmbH, Martinsried, Fed. Rep. of Germany

[21] Appl. No.: 379,788

[22] Filed: Jul. 17, 1989

[30] Foreign Application Priority Data

Apr. 4, 1989 [DE] Fed. Rep. of Germany ..... 3910889

[51] Int. Cl.[5] ..... A42B 3/00

[52] U.S. Cl. ..... 2/420; 2/421; 2/425

[58] Field of Search ..... 2/425, 421, 410, 412, 2/411, 413, 414, 417, 418, 419, 420, 209.3, 192

[56] References Cited

U.S. PATENT DOCUMENTS

| | | | |
|---|---|---|---|
| 3,087,166 | 4/1963 | Howard | 2/420 |
| 4,404,690 | 9/1983 | Farquharson | 2/425 X |
| 4,443,891 | 4/1984 | Blomgren et al. | 2/425 X |
| 4,646,367 | 3/1987 | El Hassen | 2/412 |

*Primary Examiner*—Peter Nerbun

*Attorney, Agent, or Firm*—Fleit, Jacobson, Cohn, Price, Holman & Stern

[57] ABSTRACT

The invention relates to a single-shell helmet made from a styrene or polystyrene-based foam plastic. Unlike in the case of the hitherto known one-piece helmets of this type, the invention subdivides the helmet into shell parts, which are integrated together by means of hinged areas and can be easily adapted to different head sizes by means of an adjusting system.

30 Claims, 3 Drawing Sheets

HELMET

BACKGROUND OF THE INVENTION

The invention relates to a single-shell helmet made from foamed plastic and a process for the production thereof.

For example US suppliers refer to such a helmet as a soft-shell helmet. Such helmets comprise a polystyrene-base foamed plastic and in particular Styropor. These helments comply with the ANSI standard and are conventionally given a textile covering for individual colouring purposes.

The major disadvantage of such helmets is that as a result of their closed, one-piece form, they take up a relatively large packing volume. In addition, such helmets do not have adequate flexibility for adapting to different head sizes. This adaptation has hitherto been achieved by two or three generally different helmet sizes, the finer adaptation taking place by applying soft material cushions to the inner surface of the helmet. The helmet has conventionally been fixed by means of a chin strap with a chin strap triangle.

Other protective helmets for racing cyclists are in particular constructed in two-shell form generally involving the combination of an inner rigid foam shell and an outer shock-proof plastics material shell.

An example of the latter helmet is known from DE 36 32 525 A1. However, this helmet only has a web-like, inner head protection made from flexible foamed plastic, whose size can be adjusted at the back of the head, e.g. using burr fastenings. However, from the safety standpoint, an outer rigid shell is placed over the skull. In another protective helmet, such as is known from DE 31 29 199 A1, use is made of an outer helmet shell made from shock-proof plastic with a soft inner cushioning.

However, also in the case of the last-mentioned helmets, the problem of the large packing volume, inadequate adjustability and adaptation to different head sizes still exist.

While taking into account of these disadvantages of the prior art, the problem of the present invention is to provide a helmet in a simple form with a high adaptation for comfort and while retaining the safety aspects, at the same time achieving a relatively flat packing volume and enabling production in one process step.

SUMMARY OF THE INVENTION

An important basic idea of the invention is that the hitherto known one-piece helmet shell made from a styrene or polystyrene-base foamed plastic is subdivided into several shell parts, which remain interconnected in hinge-like manner and said shell parts are brought by means of a simple adjustment system from their relatively flat packing state into the helmet shape, so that on the one hand a stable helmet shape is obtained and on the other an optimum adaptation to different head sizes is possible.

The helmet shell is therefore appropriately subdivided into several and in particular five shell parts, which are integrally interconnected by means of plate-like areas or a hinged plate. This hinged plate, which preferably is made from a thermally stable, non-stretch material, such as e.g. polyethylene, is foamed as the connection carrier during the production of the shell parts in integral manner with the latter. It is also possible to use other materials, e.g. polyurethanes or thermoplastic rubber, but account must also be taken of the weight.

At the transition areas of the individual shell parts, said hinged plate forms film hinges, which permits ready bending down corresponding to the skull shape. Obviously the inner face of the shell parts is partly adapted to the human skull contour. For optimum wearing comfort it is possible to provide in the inner helmet face soft material cushions, e.g. textile-lined foam, using burr fastenings or other fastening systems.

However, the fundamental aspect of the invention is the subdivision of the hitherto one-piece helmet shell into several shell parts, which permits a substantially flat unwinding of the helmet. This flat spreading out of the individual shell parts, which are firmly interconnected by the hinged plate, permits flat packing roughly in dimensions $38 \times 38 \times 38 \times 10$ cm. This winding out also permits the foaming of the shell parts with inserted hinged plate in a single process step.

The adjusting system is preferably an adjusting strap, connecting by means of openings the marginal shell parts of the helmet and which can be locked to the back of the head by means of a simple self-locking closure means. On tightening this pulling strap the contact faces of the outer shell parts, such as the forehead part, two side parts and back of the head part are folded or flapped together, so that the desired helmet shape is obtained. To obtain a good fit and stability, this adjustment system is supplemented by the forked chin strap, whose front strap is advantageously passed over the forehead part and whose rear strap is passed over the back of the head part. In the case of desired fixing, the strap portions can cooperate with the shell parts in burr fastening-like manner.

In place of an all-round adjusting strap, only adjacent parts may be provided with such pulling straps. With a view to simple manufacture the shell parts have openings, which permit the passage of the adjusting strap, so that tensile and compressive forces of the strap can be transferred to the outer face of the shell parts.

The air holes advantageously provided in the head back and forehead parts can be used for passing through the strap.

As the helmet shell is appropriately formed by five shell parts, for the integrated connection of the shell parts it is appropriate to have a cruciform hinged plate, whose center is located in the center parts of the helmet shell and whose arms extend into the individual shell parts. The hinged plate is preferably provided with openings, e.g. punched out openings, in order to form an intimate self-closure with the foamed-round shell parts. The hinged areas e.g. constructed as film hinges normally only extend over part of the corresponding lateral length of the shell part, which improves the foldability and adaptability to the head shape.

The facing faces of the shell parts are designed in such a way that they can rest against one another in the helmet shape, there conventionally being a small spacing of the faces in the hinged area.

The inventive idea of providing a flat, volume-saving packing form also offers the possibility of producing the helmet shell parts in a single manufacturing step. For this purpose the hinged plate is placed in a corresponding mould, so that subsequently in the manner of an injection moulded part, e.g. using the Styrofoam process, the shell parts can be foamed round the hinged plate arms and the actual hinged plate.

The foamed plastic is appropriately based on styrene or polystyrene. It is for example possible to use SB or ABS plastics or Styropor.

A helmet manufactured in this way permits a good adaptation comfort to different head sizes, so that there is no need to store different helmet sizes. The flat packing of the helmet makes it possible to reduce storage and transportation costs. From the manufacturing standpoint, an optimum single-stage process dependent on the foamed plastic used is possible.

The invention is described in greater detail hereinafter relative to an embodiment and the attached drawings, wherein it is shown:

FIG. 1: A front view of the helmet in use.

FIG. 2: A side view of the helmet.

FIG. 3: A partial section in the longitudinal direction corresponding to FIG. 2.

FIG. 4: A view of the back of the helmet.

FIG. 5: A plan view of an opening out of the helmet into an approximately flat configuration with its shell parts in a production and packing position.

FIG. 6: A diagrammatic partial section through a hinged plate in the vicinity of the film hinge and two adjacent shell parts.

DETAILED DESCRIPTION OF THE PREFERRED EMBODIMENT

Figure 1:
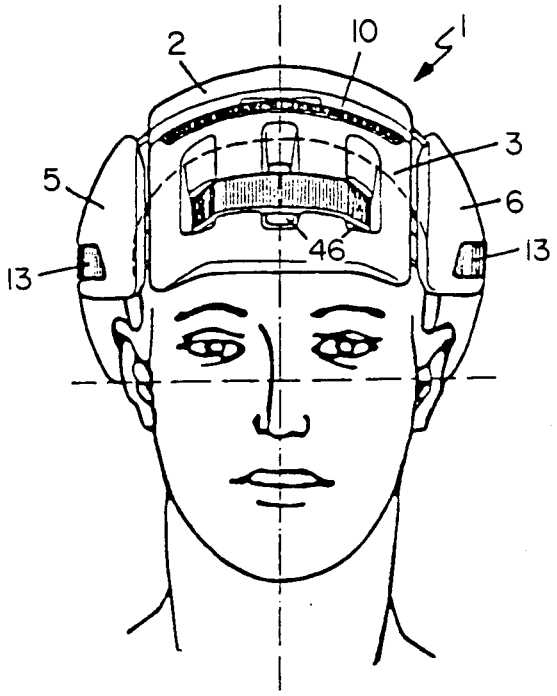
Figure 2:
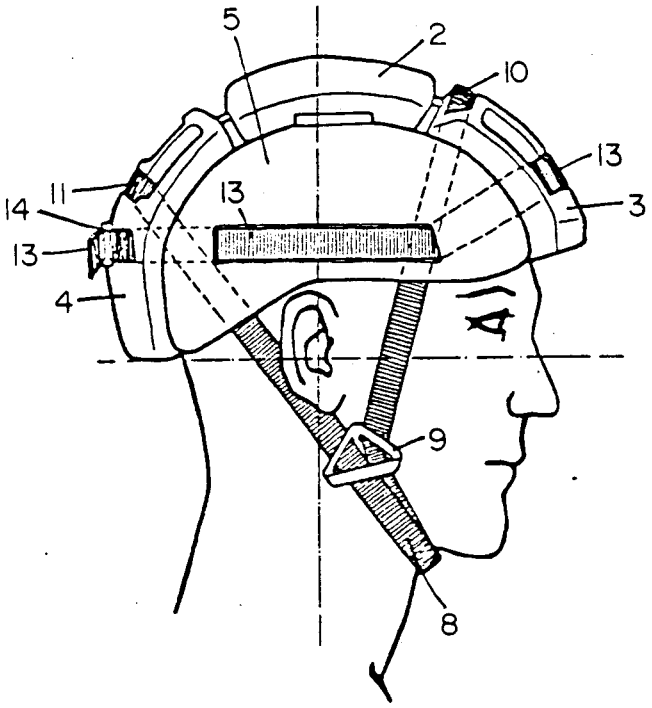

FIGS. 1 and 2 constitute a front and side view of a styrene or polystyrenebase foamed plastic, single-shell helmet 1, which has a central part 2, a forehead part 3 and a back of the head part 4, together with two side parts 5 and 6. As can be gathered from the sectional view of FIG. 3, these shell parts are interconnected by means of a hinged plate 20.

Figure 5:
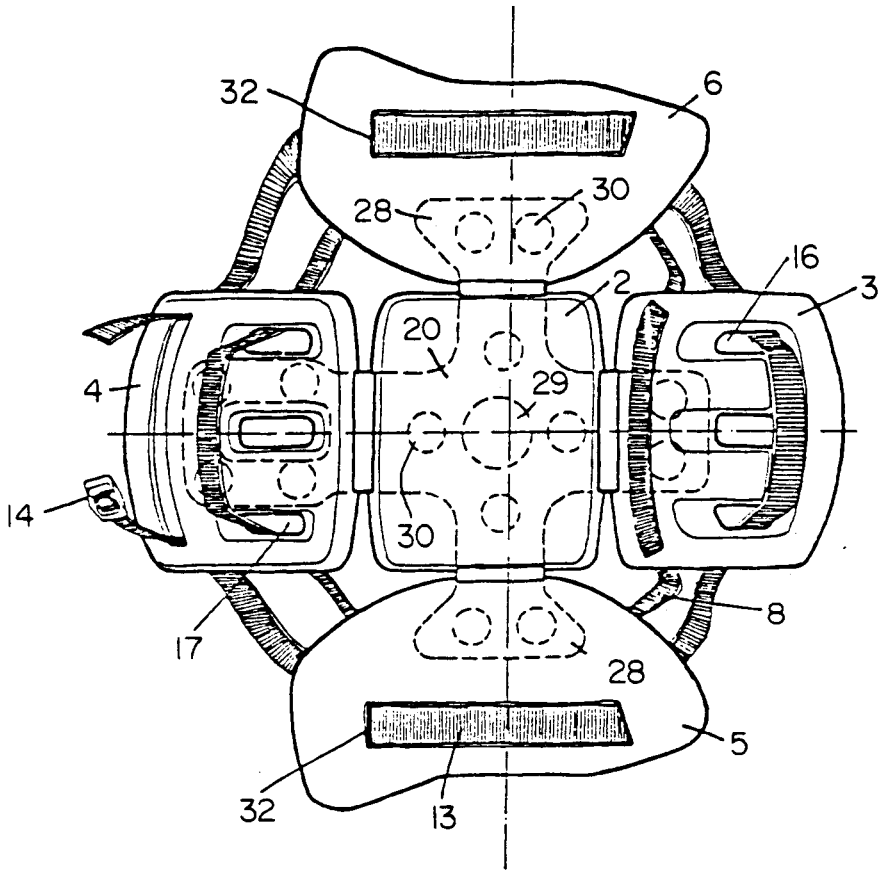

FIG. 5 shows the helmet 1 in the packing state, in which the individual shell parts 2 to 6 are spread out in an approximately flat configuration. It can be seen that despite five different shell parts 2 to 6, the helmet is shaped or moulded in an integral manner. The member interconnecting the individual shell parts is formed by a hinged plate 20, which is made from a thermally stable, nonstretch material, e.g. polyethylene or a comparable material. This hinged plate 20 is roughly cruciform, the center of the hinged plate being located in the central part 2, whereas the arms project into the marginal shell parts 3, 4, 5 and 6. In the present example, this hinged plate 20 has openings 29, 30 ensuring a positive connection with the plastic foam on foaming round the hinged plate 20. The outer areas of the hinged plate 20 are provided with widened portions 28, which ensure a greater shape-flat connection with the corresponding side part 5, 6.

The arms of the hinged plate 20 projecting into the forehead part 3 or the back of the head part 4 are adapted to the previously designed air passage holes 16, 17, which are partly surrounded.

The inventive concept makes it possible in a single operation and after insertion of the hinged plate 20 to injection mould or foam around the shell parts 2 to 6 of the helmet in a mould. This procedure produces the helmet in the flat opened-out form shown in FIG. 5, a chin strap 8 and adjusting strap 13 being subsequently drawn in.

Figure 6:
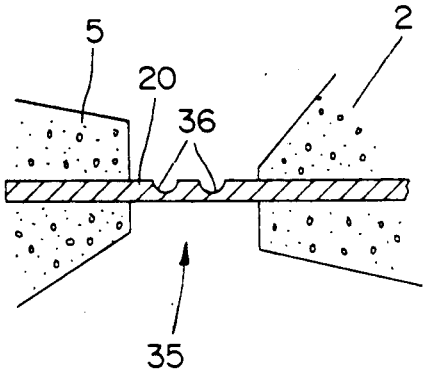

The parts of the hinged plate 20 which are left free and located between the adjacent shell parts are constructed in articulated manner, e.g. in the form of a film hinge 35, as shown in diagrammatic section in FIG. 6. For example, it is then possible to provide roughly semicircular slots 36 or "film hinges" on one side in hinged plate 2. This provides a desired bending point in the otherwise dimensionally stable hinged plate, which e.g. permits bending in a range of 90° between shell parts 2 and 5.

As in use shell parts 2 to 6 must give a dimensionally stable, one-shell helmet, an adjusting system in the form of an adjusting strap 13 is provided, which reliably interconnects the marginal shell parts 3, 5, 4, 6. This adjusting strap 13 is provided on the back of the head part 4 with an adjustable, self-locking closure 14.

This adjusting strap 13 is so passed through the shell parts through air holes 16 or openings 32 provided for this purpose, that it passes mainly on the outer face thereof. It is optionally also possible to provide a strap depression in the shell parts.

Thus, when using the helmet 1, the latter is firstly brought out of its packing state (FIG. 5) and one end of the adjusting strap is passed through the closure 14. The user is then able, in accordance with his head size, to so tension the adjusting strap that an optimum fit on the head is achieved. In winter, the user could even wear a hat and adapt the helmet 1 thereto. A forked chin strap 8 is provided for securing the neck-chin area and it is passed over a chin strap triangle 9 (FIG. 2), in which the front strap 10 and rear strap 11 come together. The front strap 10 appropriately passes over the part of the forehead part 3 oriented towards the central part 2. The rear strap 11 roughly passes on the outside in the central area of the back of the head part 4 and is guided downwards to the helmet interior via air slots 17.

Thus, in the represented embodiment of the helmet, the central part 2 remains strap-free, whilst the forked chin strap is passed over the forehead part 3 and the back of the head part 4. The adjusting or pulling strap 13 interconnects all four external shell parts 3, 5, 4, 6.

At desired points the straps 10, 11, 13 can also be fixed by mounting supports, such as burr fastenings, which ensures a slip-free use.

FIG. 2 shows that the adjusting strap 13 initially slopes on the forehead part 3 and then passes in side part 5 in a roughly horizontal line over the ear to the closure 14.

Figure 3:
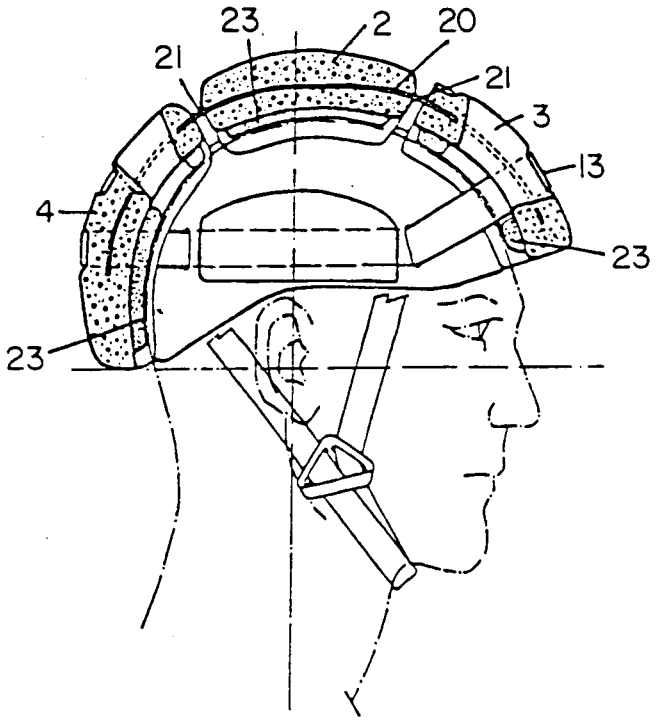
Figure 4:
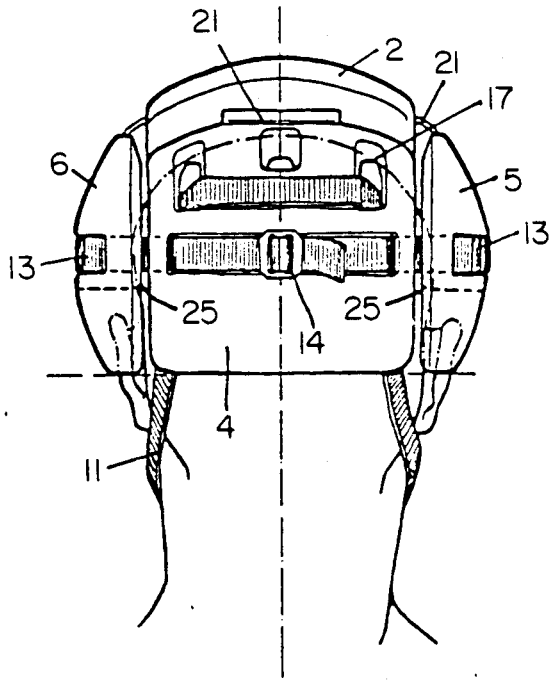

In the sectional representation according to FIG. 3 the individual shell parts 2, 3, 4 have a slight spacing in the vicinity of the film hinges 21. As a function of the head circumference, other facing faces of the shell parts 5, 6 can have a small reciprocal spacing 25 (FIG. 4) or can be in direct engagement with one another.

In order to improve the wearing comfort, the inner contour of the shell parts adapted to the skull shape can be additionally provided with a soft material cushion 23.

In accordance with FIG. 3 the hinged plate 20, which can pass through the individual shell parts into the marginal area thereof, can be foamed in roughly in the center of the shell parts. Thus, the hinged plate 20 leads to a better dimensional stability of helmet 1 and permits its flat winding out and contour adaptation. Thus, the inventive helmet 1 leads to a major advantage from the packing standpoint and through its adaptation possibilities, permits rapid adaptation to different head sizes. At any time a textile and possibly colored covering can be drawn over the helmet.

I claim:

1. A helmet comprising a plurality of foamed plastic shell parts, plate-like sections integrated within the foamed plastic shell parts interconnecting in an articulated manner the individual shell parts, and at least several shell parts being connected to a regulatable adjusting system for producing a usable shape of the helmet from an approximately flat configuration.

2. Helmet according to claim 1, further comprising a forked chin strap, and the plate-like sections form a cruciform hinged plate foamed into the shell parts.

3. Helmet according to claim 1, wherein the hinged plate is made from a thermally stable, film hinge-like material and has plate recesses.

4. Helmet according to claim 1, wherein the shell parts include a central part, a forehead part, a back of the head part and two side parts as five shell parts, which have facing lateral surfaces.

5. Helmet according to claim 1, wherein the adjusting system is constructed as an adjusting strap, interconnecting marginal shell parts through openings.

6. Helmet according to claim 4, wherein the side parts have a roughly kidney-shaped contour and the further shell parts have a roughly quadrangular contour, the inner contour of the shell parts being adapted to the skull curvature.

7. Helmet according to claim 4, wherein the plate-like sections between the central part and the outer shell parts are constructed as film hinges.

8. Helmet according to claim 1, wherein the shell parts can be spread out in an approximately flat configuration with the adjusting system released.

9. Helmet according to claim 4, wherein a forked chin strap is passed in slip-proof manner over the forehead part and back of the head part.

10. Helmet according to claim 1, wherein an inner contour of the shell parts has soft cushions.

11. Helmet according to claim 1, wherein the articulated connection is provided between adjacent shell parts.

12. Helmet according to claim 1, further comprising a forked chin strap, and the plate-like sections form a radial hinged plate foamed into the shell parts.

13. A helmet comprising a plurality of foamed plastic shell parts, plate-like sections integrated within the foamed plastic shell parts, said plate-like sections interconnect in an articulated connection said several shell parts to form a helmet, and some of said several shell parts being connected to a regulatable adjusting system for producing a usable shape of the helmet from an approximately flat configuration of the helmet used for packing purposes.

14. Helmet according to claim 13, wherein the plate-like sections are made from a thermally stable, film hinge-like material and the foamed plastic shell parts are made of a polystyrene-base foamed plastic.

15. Helmet according to claim 13, wherein the shell parts include a central part, a forehead part, a back of the head part and two side parts as five shell parts which have facing lateral surfaces.

16. Helmet according to claim 13, wherein the adjusting system is constructed as an adjusting strap, interconnecting marginal shell parts through openings.

17. Helmet according to claim 15, wherein the plate-like sections between the central part and the corresponding outer shell parts are constructed as film hinges.

18. Helmet according to claim 13, wherein the shell parts can be spread out in an approximately flat configuration with the adjusting system released.

19. Helmet according to claim 13, wherein the plate-like sections form a cruciform hinged plate foamed into the shell parts, said hinged plate having plate recesses.

20. Helmet according to claim 13, wherein the articulated connection is provided only over part of the length of a plate-like section.

21. A helmet comprising a plurality of foamed plastic shell parts, plate-like sections integrated within the foamed plastic shell parts interconnecting by an articulated connection the individual shell parts as a helmet, at least several shell parts being connected to a regulatable adjusting system for producing a usable shape of the helmet from an approximately flat configuration and the shell parts include a central part, a forehead part, a back of the head part and two side parts as five shell parts, which have facing lateral surfaces.

22. Helmet according to claim 21, wherein the plate-like sections form a cruciform hinged plate foamed into the shell-parts.

23. Helmet according to claim 21, wherein the hinged plate is made from thermally stable, film hinge-like material and has plate recesses.

24. Helmet according to claim 21, wherein the adjusting system is constructed as an adjusting strap, interconnecting marginal shell parts through openings.

25. Helmet according to claim 23, wherein the plate-like sections between the central part and outer shell parts are constructed as film hinges.

26. Helmet according to claim 21, wherein the shell parts can be spread out in an approximately flat configuration with the adjusting system released.

27. Helmet according to claim 21, wherein an inner contour of the shell parts has soft cushions.

28. Helmet according to claim 21, wherein the articulated connection is provided only over part of the length of the plate-like sections.

29. Process for the production of a helmet from foamed plastic with several shell parts and plate-like sections interconnecting in an articulated manner the shell parts, said process comprising placing the plate-like sections in a mould, and foaming in a single process step the shell parts of the helmet in an approximately flattened, spread-out configuration around the plate-like sections.

30. Process for the production of a helmet from foamed plastic with several shell parts and plate-like sections forming a radial hinged plate, interconnecting in an articulated manner the shell parts, said process comprising placing the hinged plate in a mould, and foaming in one process step the shell parts of the helmet in an approximately flat configuration having a spread-out form around the hinged plate.

* * * * *